US007036276B1

(12) United States Patent
Apel

(10) Patent No.: US 7,036,276 B1
(45) Date of Patent: May 2, 2006

(54) DIRECTED LIFESTYLE RESIDENTIAL HOUSING STRUCTURES

(75) Inventor: Robert J. Apel, Columbus, OH (US)

(73) Assignee: Directed Lifestyle, LLC, Dublin, OH (US)

( * ) Notice: Subject to any disclaimer, the term of this patent is extended or adjusted under 35 U.S.C. 154(b) by 0 days.

(21) Appl. No.: 10/664,526

(22) Filed: Sep. 17, 2003

(51) Int. Cl.
*E04H 1/00* (2006.01)

(52) U.S. Cl. ..... 52/79.1; 52/169.3; 52/169.2; 52/79.8; 52/79.4; 52/79.7; 52/234; 52/169.4; 52/79.3

(58) Field of Classification Search ..... 52/79.1, 52/79.4, 79.7, 79.8, 169.3
See application file for complete search history.

(56) References Cited

U.S. PATENT DOCUMENTS

| | | | | | |
|---|---|---|---|---|---|
| 1,464,189 | A | * | 8/1923 | Hustace | 52/236.3 |
| 1,706,496 | A | * | 3/1929 | Pieri | 52/169.3 |
| 2,878,665 | A | | 3/1959 | Crabbe | 52/169.6 |
| 2,893,066 | A | * | 7/1959 | Perdue | 52/79.8 |
| 3,479,781 | A | | 11/1969 | Johnson | 52/169.3 |
| 3,550,334 | A | * | 12/1970 | Van Der Lely | 52/79.7 |
| 3,640,037 | A | * | 2/1972 | Renauld et al. | 52/169.3 |
| 3,955,328 | A | * | 5/1976 | Lindsay | 52/73 |
| 4,007,565 | A | * | 2/1977 | Finnegan | 52/169.3 |
| 4,041,661 | A | * | 8/1977 | Hurwitz | 52/169.4 |
| D269,909 | S | | 7/1983 | Obarowski | D25/23 |
| 4,575,977 | A | * | 3/1986 | Taylor | 52/169.3 |
| 4,575,997 | A | * | 3/1986 | Van Paradijs et al. | 56/16.4 R |
| 4,622,787 | A | * | 11/1986 | Scott | 52/58 |
| 4,685,260 | A | * | 8/1987 | Jenn | 52/169.3 |
| 4,763,451 | A | * | 8/1988 | Butcher | 52/79.1 |
| 4,854,094 | A | * | 8/1989 | Clark | 52/79.1 |
| 5,394,897 | A | * | 3/1995 | Ritchey et al. | 135/124 |
| 5,469,673 | A | * | 11/1995 | Raynor et al. | 52/79.7 |
| 5,671,570 | A | * | 9/1997 | Kaufman et al. | 52/169.2 |
| 5,845,441 | A | * | 12/1998 | Swartz | 52/250 |
| 5,941,034 | A | * | 8/1999 | Frankfurt | 52/236.3 |
| 6,470,633 | B1 | * | 10/2002 | Showen | 52/169.1 |
| 6,484,454 | B1 | * | 11/2002 | Everhart | 52/79.4 |
| 2002/0095891 | A1 | | 7/2002 | Duany | 388/856 |

OTHER PUBLICATIONS

Ringsrud, D., and Ringsrud, R. The Long Journey Back—Prairie Homestead [online]. 2pp. [retrieved on Apr. 3, 2003]. Retrieved from the Internet <URL: www.ringsrud.com/prai-re.htm>.

Property listing. Jack Travis, HER Realtors, Inc. [online] [retrieved on Apr. 7, 2003]. 3pp. Retrieved from the Internet <URL: http://herrealtors.com/jack.travis/MyListingsDetails>.

(Continued)

*Primary Examiner*—Peter M. Cuomo
*Assistant Examiner*—Erika Garrett
(74) *Attorney, Agent, or Firm*—Standley Law Group LLP

(57) ABSTRACT

The present invention discloses a residential housing unit that is flexible to serve the changing needs in a family life cycle by providing two living units connected by common space. Each living unit is self-sufficient in that it may contain all the amenities necessary for independent living. Each living unit may be built on its own real estate lot and may be financed separately for ease in buying and selling. The common space may be built so as to divide the property line and may further comprise a removable, common wall.

13 Claims, 17 Drawing Sheets

OTHER PUBLICATIONS

Property record search, Reference No.—010-44933-00 [online], Franklin County, OH Auditor. 7pp. [retrieved on Apr. 16, 2003]. Retrieved from the Internet <URL: http://franklin.governmaxa.com/propertymax/rover30.asp>.
Property listing of 455 Muirfield Drive. Barbara Tyner, RE/MAX Ocean Forest [online] [retrieved on Apr. 7, 2003]. 3pp. Retrieved from the Internet <URL: www.myrtlebeachproperty.com/455MUIRFIELD.htm>.
Property listing of 3625 Peninsula Drive, Akron, OH [online] [retrieved on Apr. 4, 2003]. 4pp. Retrieved from the Internet <www.ahouseforsale.com>.
Property listing of 409 Brownell-Howland. Steve Thompson [online] [retrieved Apr. 4, 2003]. 2pp. Retrieved from the Internet <URL: www.stevethompson.com/409_brownell.htm>.
Specification and Floor Plan. Sunlight Homes. [online] [retrieved on Apr. 4, 2003]. 3pp. Retrieved from the Internet <URL: www.sunlighthomes.com/home/t.specs.html>.
Property listing of 9911 Glendale Ave. NE Albuquerque, NM. Sunlight Homes [online] [retrieved on Apr. 4, 2003]. 7pp. Retrieved from the Internet <URL: www.sunlighthomes.com/home/t.specs.html>.
Property listing 116 McLaws Street. Celia W. Dunn Realty Company [online] [retrieved on Apr. 4, 2003]. 2pp. Retrieved from the Internet <URL: www.celiadunn.com/116mclaws.html>.
Property listing of the Casa Blanca Guest House. Cyndi's Beach Home Rentals [online] [retrieved on Apr. 3, 2003]. 2pp. Retrieved from the Internet <URL:www.rockypointvacationhomes.com/casa_blanca_guest_house.html>.
Reed, B. and Reed D. Property listing of Reed's Winborn Haven and Guest Cottage. 408 Houston Street, Jefferson, Texas [online] [retrieved on Apr. 3, 2003]. 1p. Retrieved from the Internet <URL: http://jeffersontx.com/winbornhaven>.
Property listing of 820 Timberwood, Fairview, Texas. Tom Grisak Estate Homes, Relators [online] [retrieved on Apr. 3, 2003]. 2pp. Retrieved from the Internet <URL:www.grisak.com>.
Property listing of 1960 Post Oak Dr., Corinth, TX. Vanderlaan Newland & Associates, Real Estate [online] [retrieved on Apr. 3, 2003]. 2pp. Retrieved from the Internet <URL:www.northtexasrealestate.com/1960postoak.asp>.
Property listing of 4507 Lakeview Dr., Belton, TX. Texas Mortgage Company [online][retrieved on Apr. 3, 2003]. 1p. Retrieved from the Internet <URL:www.americanhomefinders.com>.
Property listing of 4645 Miller Rd., Lake Montezuma, AZ. Jack and Sue Dunigan, Owners [online] [retrieved on Apr. 3, 2003]. 1p. Retrieved from the Internet <URL:www.geocities.com/jddunigan>.
Property listing Mercer Island Lake View Estate. Loren Chotzen, The Landmark Group [online] [retrieved on Apr. 3, 2003]. 2pp. Retrieved from the Internet <URL:www.lorenchotzen.com/miestate>.
Property listings. Denise Daughtry [online] [retrieved on Apr. 3, 2003]. 21pp. Retrieved from the Internet <URL: www.filmnorthflorida.com/locations/Floridatown-dinner>.
Property listing of 1887 Feigel House. Dan Wessels, Black Hills Country Builders, Inc. [online] [retrieved on Apr. 3, 2003]. 6pp. Retrieved from the Internet <URL:www.bhcbinc.com>.
Lindale House. Roane Alliance [online] [retrieved on Apr. 3, 2003]. 1p. Retrieved from the Internet <URL: www.roanealliance.org/virtual%20tours/lindale.html>.
Property listing of the Gambier House Bed & Breakfast Inn. 107 East Wiggin Street, Gambier, OH [online] [retrieved on Apr. 3, 2003]. 3pp. Retrieved from the Internet <URL:www.gambierhouse.com>.
O'Neil, Caitlin, 'Adding On—This Old House constructed a freestanding addition to a Victorian cottage in Newton, Massachusetts' [online]. 3pp. This Old House Online. [retrieved Apr. 3, 2003] Retrieved from tne Internet <URL: http://affiliate.timeincmags.com/toh>.
Description and picture of 510 W. 23rd , Austin, TX. New Guild Co-op [online] [retrieved on Apr. 3, 2003]. 2pp. Retrieved from Internet <URL: www.iccaustin.coop/newguild.html>.
Property listing for Highland Farms in Lexington, Kentucky. Nathan Hart [online] Key Real Estate Group L.L.C. [retrieved Apr. 4, 2003]. 4pp. Retrieved from the Internet <URL: www.luxuryforsale.com/real_estate/for_sale/kentucky/blue_grass/horse_farm.htm>.
'What Buyers Want'. eNeighborhoods [online] [retrieved on Apr. 3, 2003]. 2pp. Retrieved from Internet <URL: www.mikehathorne.com.Articles/eNeighborhoods/What%20Buyers%20Want.htm>.
'In Search of the Dogtrot House'. northbysouth.org [online] [retrieved on Apr. 3, 2003]. 3pp. Retrieved from the Internet <URL: www.northbysouth.org/2002/Space/Evans%20Dogtrot%20Page.htm>.
Williams, Dennis. Murgon House [online] [retrieved on Apr. 3, 2003]. 1p. Retrieved from the Internet <URL:www.giftnut.com/murgon_house.htm>.
Harrison. Laura. Paradise Inn. Architecture in the Parks, Excerpts From A National Historic Landmark Theme Study. National Park Service [online]. Department of the Interior Nov. 1986 [retrieved on Apr. 3, 2003]. 8pp. Retrieved from the Internet <URL: www.cr.nps.gov/history/online_books/harrison/parrison11.htm>.
Whiting, Ron. Plan # OOD-Poydras. Collective Designs [online ] [retrieved on Apr. 3, 2003]. 2pp. Retrieved from Internet <URL: www.collectivedesgns.com/dsgnr/ood0900/ood-poydras.htm>.
Whiting, Ron. Plan # OOD-Ormand. Collective Designs [online] [retrieved on Apr. 3, 2003]. 2pp. Retrieved from Internet <URL: www.collectivedesgns.com/dsgnr/ood0900/ood-ormand.htm>.
Whiting, Ron. Plan # OOD-Belgrade. Collective Designs [online] [retrieved on Apr. 3, 2003]. 2pp. Retrieved from Internet <URL: www.collectivedesgns.com/dsgnr/ood0900/ood-belgrade.htm>.
North Central Texas Council of Governments, Department of Environmental Resources [online] [retrieved on Apr. 3, 2003]. 2pp. Retrieved from the Internet <URL: www.dfwinfo.com/envir/coordinated/REGCODES/archive/apstairs.html>.
Zimny, Michael. 'Dog-Trots, Saddlebags & Shotguns—Vernacular houses in Florida'. Florida Heritage Magazine [online] [retrieved on Apr. 3, 2003]. 4pp. Retrieved from the Internet <URL: www.flheritage.com/magazine/spring96/samp_art.html>.
Reference No.—NDG453—Heather Ridge house plans. 10000HomePlans.com [online] [retrieved on Apr. 3, 2003]. 2pp. Retrieved from the Internet <URL: www.10000homeplans.com/PLAN0010428.html?id=anbfvDVf>.

Reference No.—NDG429—Ivy Green house plans. 10000HomePlans.com [online] [retrieved on Apr. 3, 2003]. 2pp. Retrieved from the Internet <URL: www.10000homeplans.com/PLAN0010404.html?id=anbfvDVf>.
Alexander Park. The New (Cross) Garden. The State Museum (Tzarskoje Selo) [online] [retrieved on Apr. 8, 2003]. 1p. Retrieved from the Internet <URL: http://eng.tzar.ru/alexander_park/new_garden/chineses_village>.
Property listing Reference No. 774. Competa Real Estate S.L. Spain [online] [retrieved on Apr. 8, 2003]. 1p. Retrieved from the Internet <URL: www.competa-real.com/../../774.htm>.
Winn-Yeaton Connected Houses. Strawbery Banke Museum [online] Portsmouth, NH [retrieved on Apr. 3, 2003]. 2pp. Retrieved from the Internet <URL:www.strawberybanke.org/museum/winnyeaton.html>.
Village Type. Virtual Montana Project. Liverpool Hope University College [online] [retrieved on Apr. 8, 2003]. 2pp. Retrieved from the Internet <URL: www.virtualmontana.org/virtual/montana/romania/village2.htm>.
Benson, Dan. 'In '90s boom times, state families built big' [online]. Milwaukee Journal Sentinel [retrieved on Apr. 4, 2003]. 3pp. Retrieved from the Internet <URL:www.jsonline.com/news/ozwash/may02/43378.asp?format=print>.
A Living Shelter. Units 4 and 5 [online] [retrieved online Apr. 4, 2003]. 10pp. Retrieved from the Internet <URL: http://scholar.lib.vt.edu/theses/available/etd-21398-153823/unrestricted/unit-4.pdf>.
Tryggestad, Erik 'Gillsville House Wins Award' [online]. Athens Banner-Herald [retrieved on Apr. 3, 2003]. 1p. Retrieved from the Internet <URL: www.onlineathens.com/stories/020399/new_0203990019.shtml>.

* cited by examiner

LOWER LEVEL

FIRST FLOOR

SECOND FLOOR

SECOND FLOOR

SECOND FLOOR

DIRECTED LIFESTYLE RESIDENTIAL HOUSING STRUCTURES

BACKGROUND AND SUMMARY OF THE INVENTION

The present invention relates generally to housing structures and more particularly to a residential housing unit that provides two living units connected by common space. Each living unit is self-sufficient in that it contains all the amenities that are necessary for independent living. Each living unit is built on its own property lot and may be financed separately for ease in buying and selling or may be financed by one owner.

Patio homes, duplexes, homes with mother-in-law suites, both internal and external to the main residence, and apartments, with or without a common entrance area are well known alternatives to traditional individual residential homes. The alternative homes listed above are built upon one lot.

The present invention is a housing structure that is built on two individual lots and contains two independent living units that may be of varying size. The lots and homes may be deeded to two owners. The property line for the two lots preferably runs between the two independent living units through a common enclosed area.

Each independent living unit is fully functioning in that each unit may have its own source of heat, air conditioning, plumbing, septic system, water heater, electrical supply, etc. Each living unit may have its own foundation, its own external entrance, one or more bedrooms, one or more kitchens, one or more living spaces, one or more bathrooms and each may have its own single or multi-car garage.

The individual living units are preferably connected to each other by common space. The common space may be the central hub and may be open to the largest amount of private and public green space that surrounds the dwelling. The common space may be a so-called "Florida room" with screens or windows, a hallway, a private or shared activity room, an exercise room, an enclosed or open breezeway, a porch, a dining room, a private or shared laundry room, or any other room that is suited to simultaneous or temporal sharing between living units. The common space may have a removable center wall that separates the individual living units.

The placement of two disparate size housing structures on two individual lots with connecting common space also leads to an aesthetic advantage in that there may appear to be more green space per lot. For example, instead of the 5–10 feet typically required between homes there might be more than 18 feet on the side of the dwelling. The value of the homes in the neighborhood may go up as a result of having what appear to be large homes on large lots with ample green space.

The residential housing structure is named "directed lifestyle" because it is anticipated that a family may live in one or the other or both of the structure(s) as needed at different stages. When less space is needed or when income levels are lower, the smaller independent living unit may be utilized while preferably renting out or selling the larger independent living unit to another related or non-related tenant or owner. When the family has expanded and more space is required or when income levels are greater, the larger independent living unit may be utilized and the smaller unit may be rented or sold. One family may also use the entire two structures at the same time, effectively as one home. The flexibility of the attached common space is key to making the structure appear to be one home even though built on two real estate lots.

In addition to the novel features and advantages mentioned above, other features and advantages of the present invention will be readily apparent from the following descriptions of the drawings and exemplary embodiments.

DETAILED DESCRIPTION OF EXEMPLARY EMBODIMENT(S)

Figure 1:
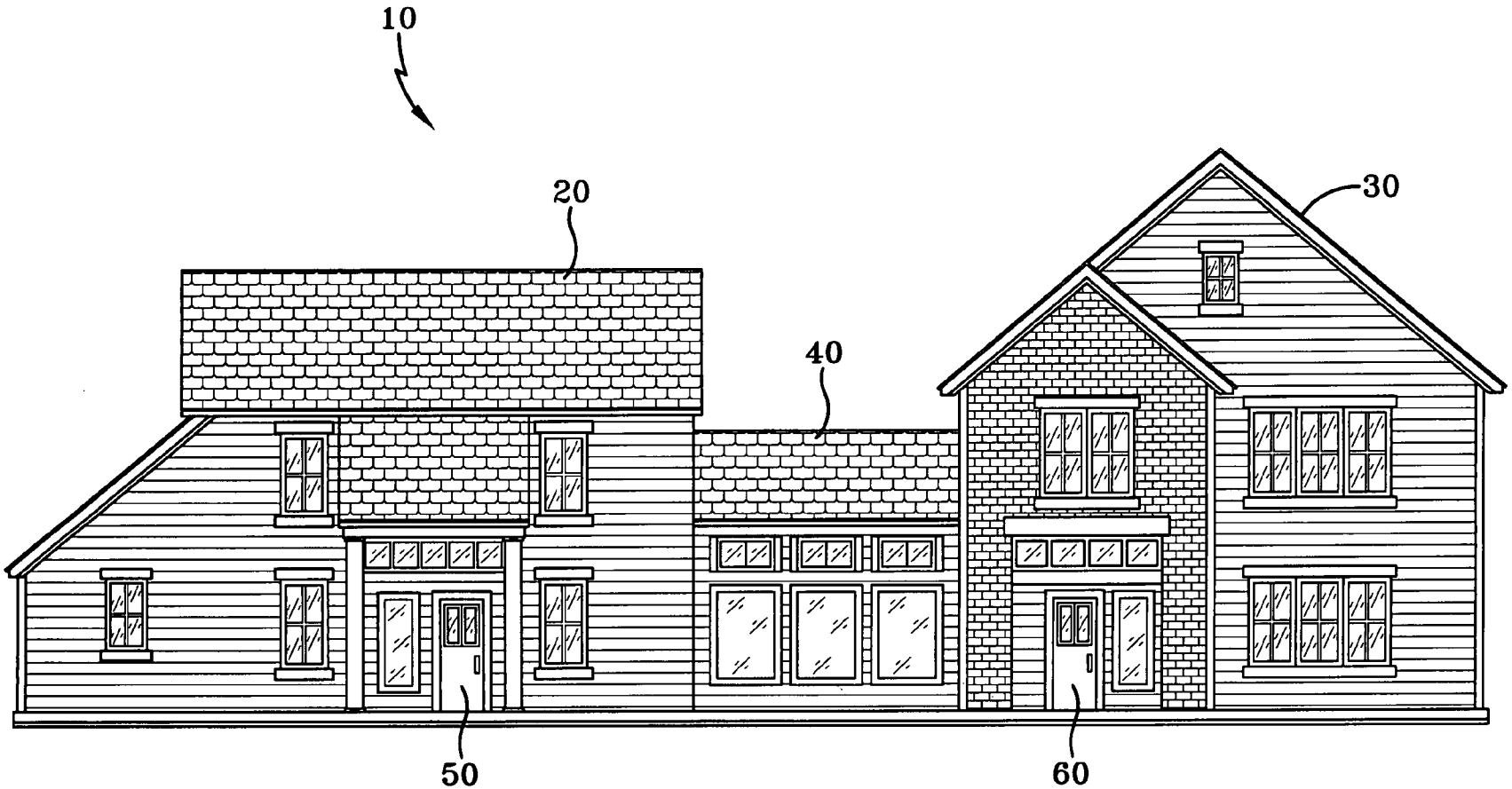
FIG. 1 is a front elevational view of the facade of one exemplary embodiment of the housing structure according to the present invention.
Figure 2:
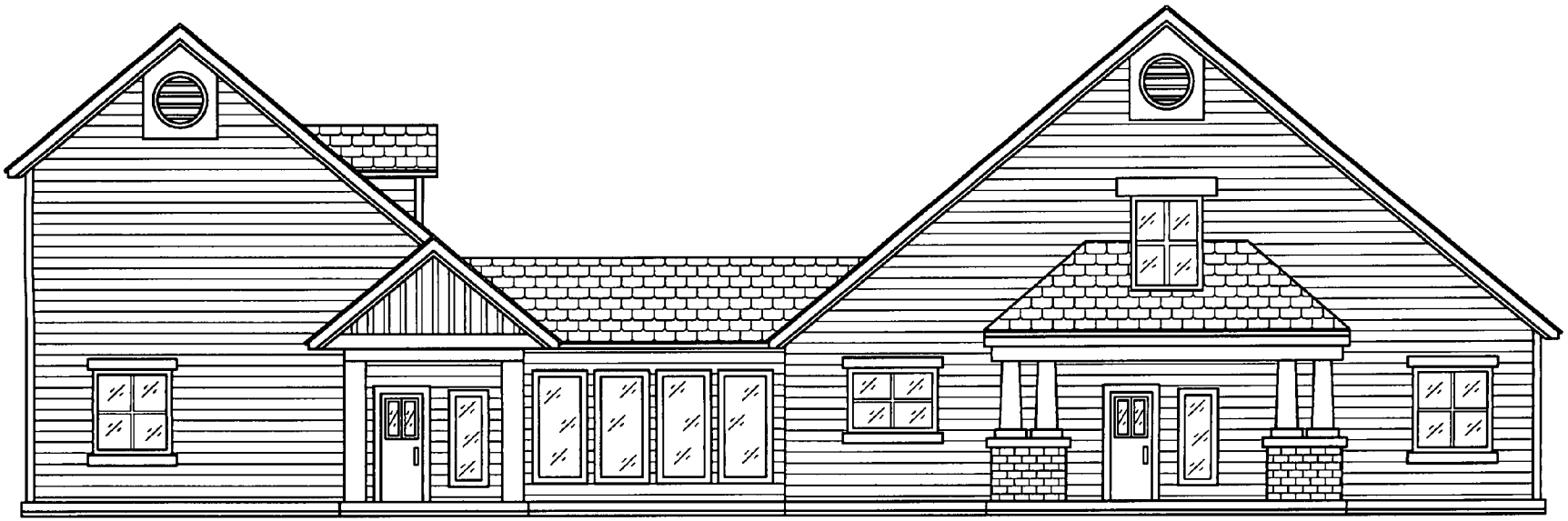
FIG. 2 is a front elevational view of the facade of another exemplary embodiment of the housing structure according to the present invention.
Figure 3:
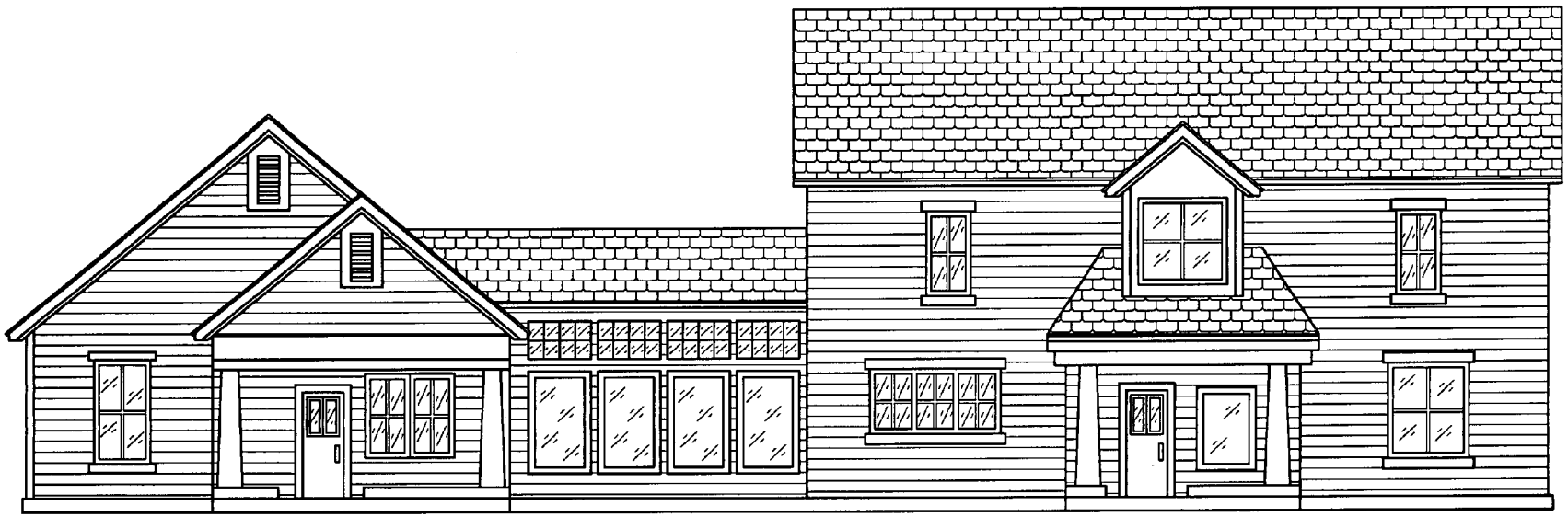
FIG. 3 is front elevational view of the facade of yet another exemplary embodiment of the housing structure according to the present invention.

As shown in FIG. 1, the present invention is directed to a residential housing unit 10 that provides two living units 20 and 30 connected by common space 40. The common space may be divided into two. Each living unit 20 and 30 has its own outside entry 50 and 60. Other embodiments of the present invention are shown in FIG. 2 and FIG. 3.

Figure 4A:
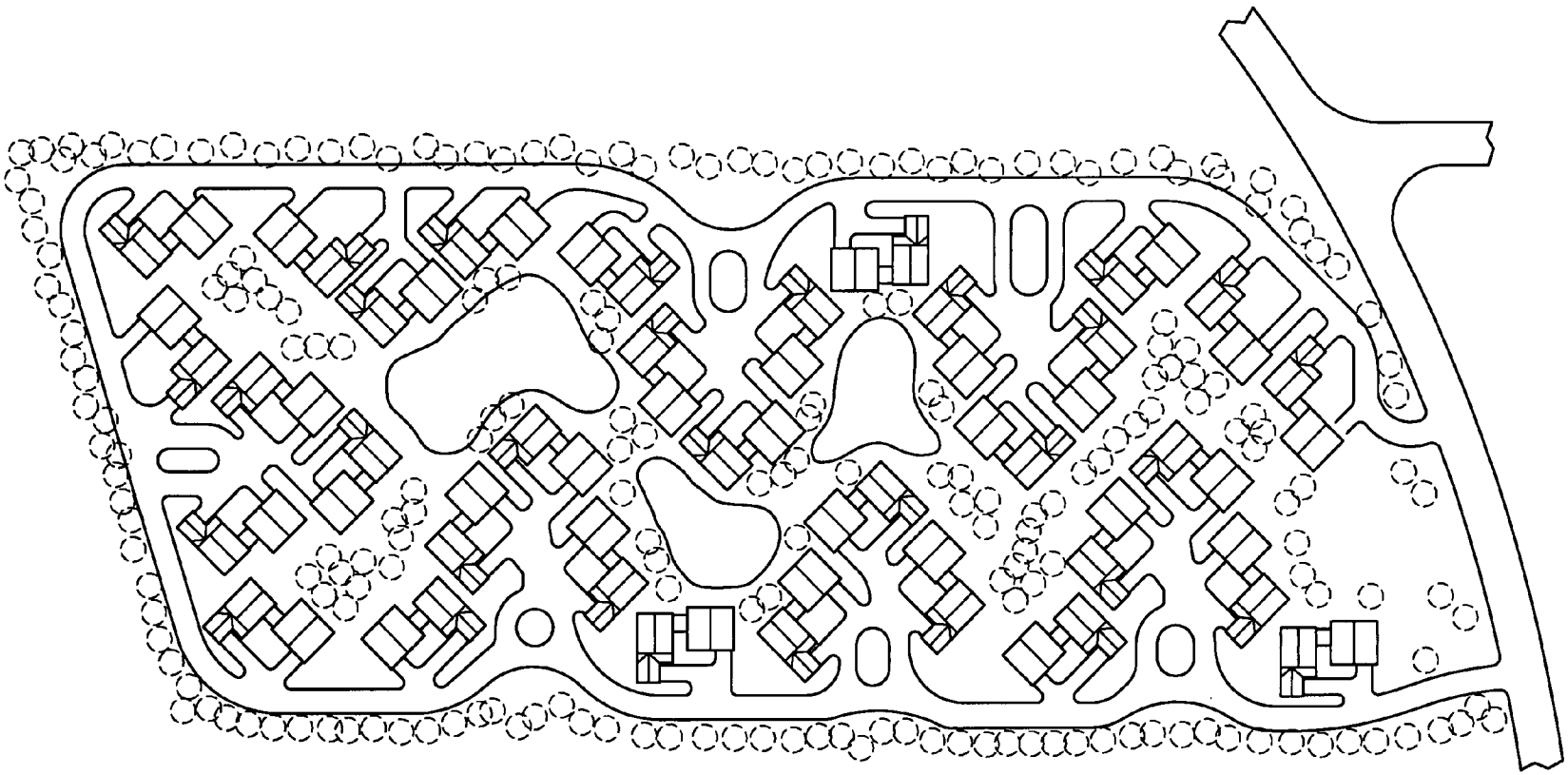
FIG. 4A is an exemplary subdivision plan demonstrating the relationship of the residential dwelling units according to the present invention.

An exemplary site plan is shown in FIG. 4A. It shows 33 residential housing units comprised of 66 independent living units. In this example, there are 17.5 acres in the site, which results in 3.8 independent living units per acre.

Figure 4B:
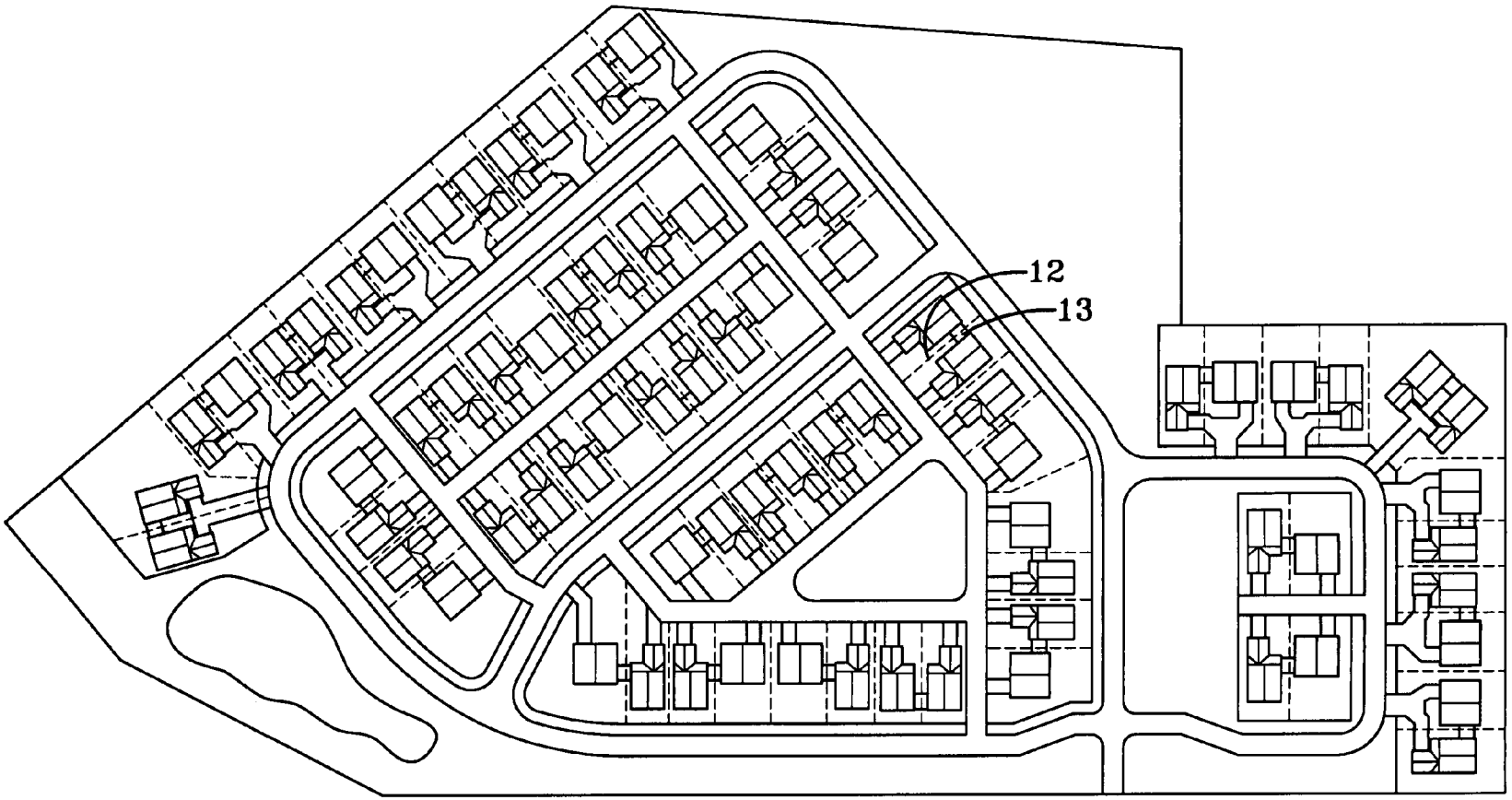
FIG. 4B is another exemplary subdivision plan according to the present invention.
Figure 5:
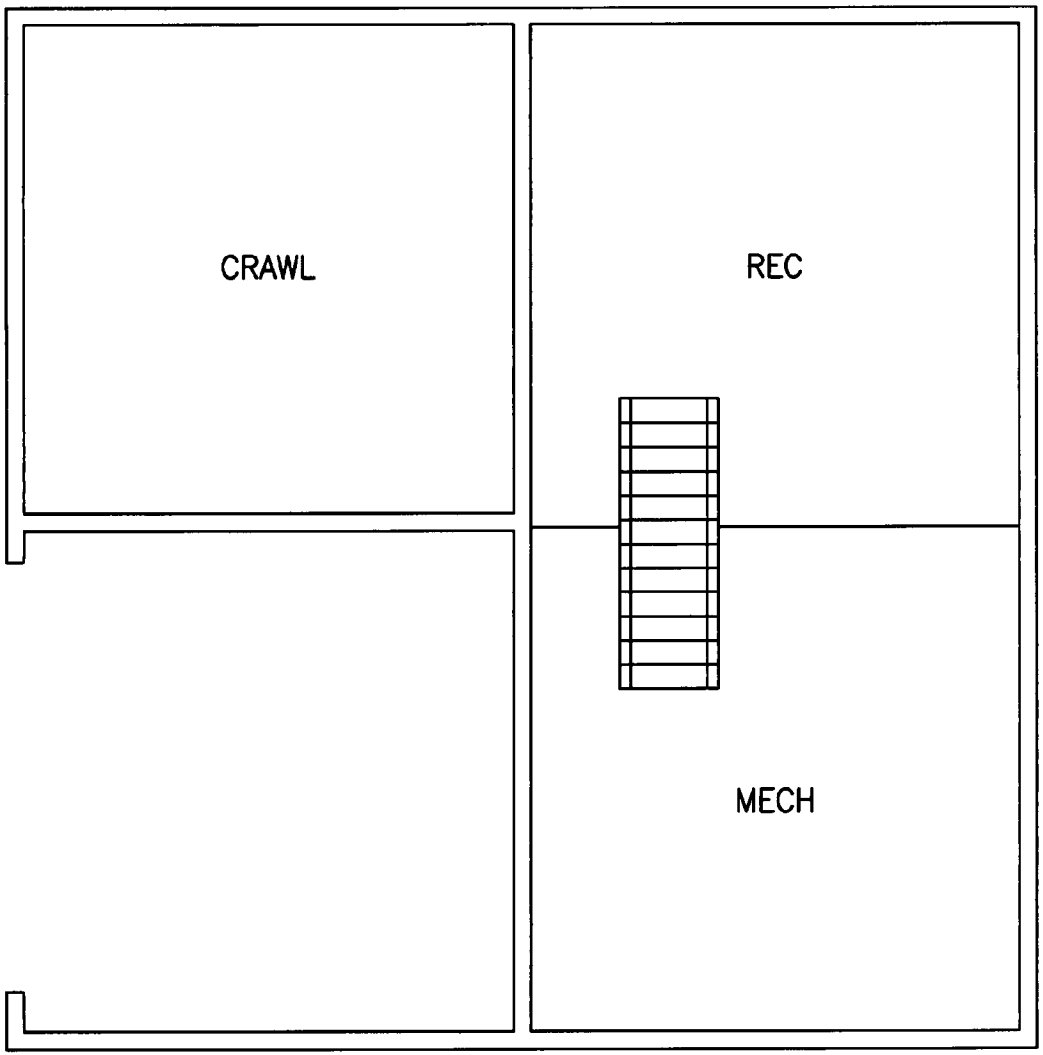
FIG. 5 is a plan view of the lower level of an exemplary residential unit according to the present invention.
Figure 6:
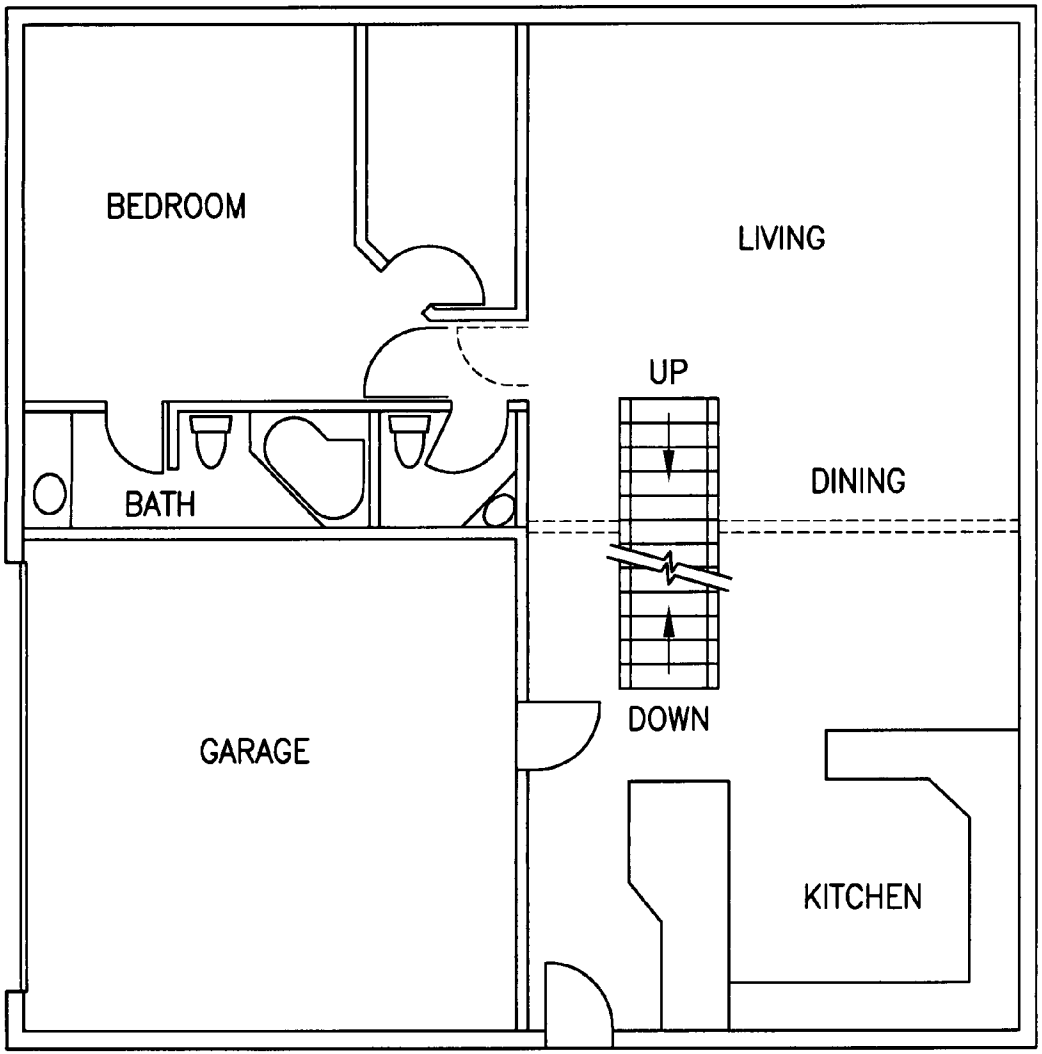
FIG. 6 is a plan view of the first floor of an exemplary residential unit according to the present invention.
Figure 7:
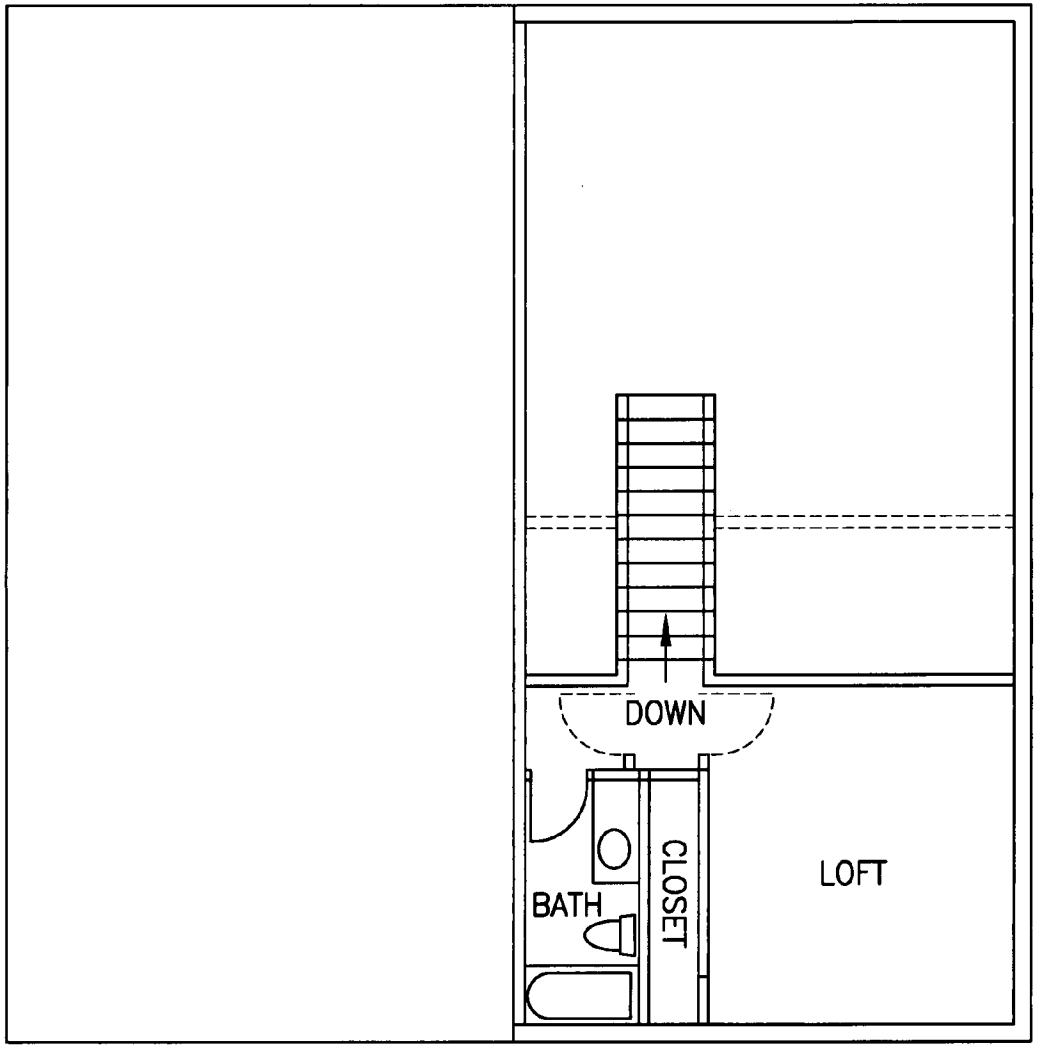
FIG. 7 is a plan view of the second floor of an exemplary residential unit according to the present invention.
Figure 8:
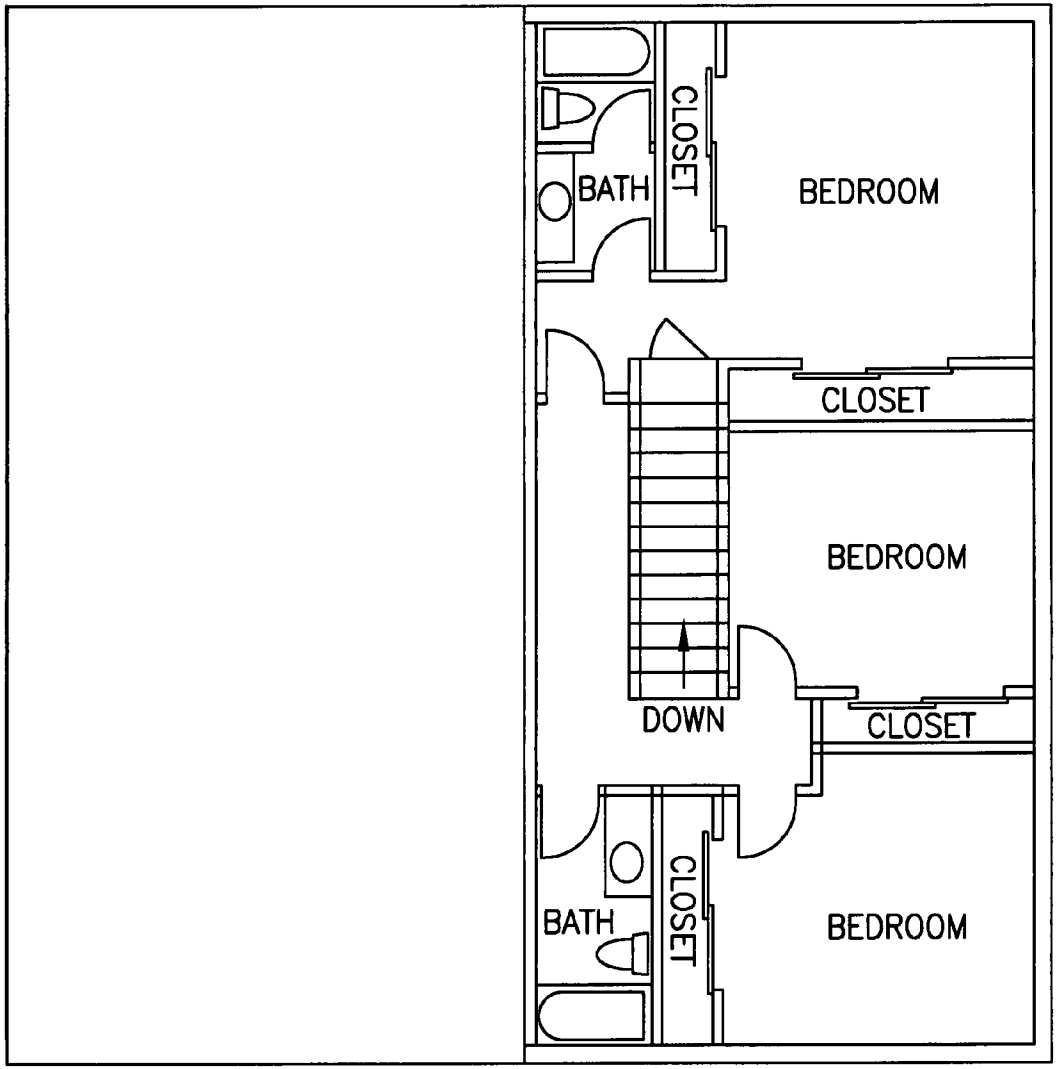
FIG. 8 is a plan view of the alternate second floor of an exemplary residential unit according to the present invention.
Figure 9:
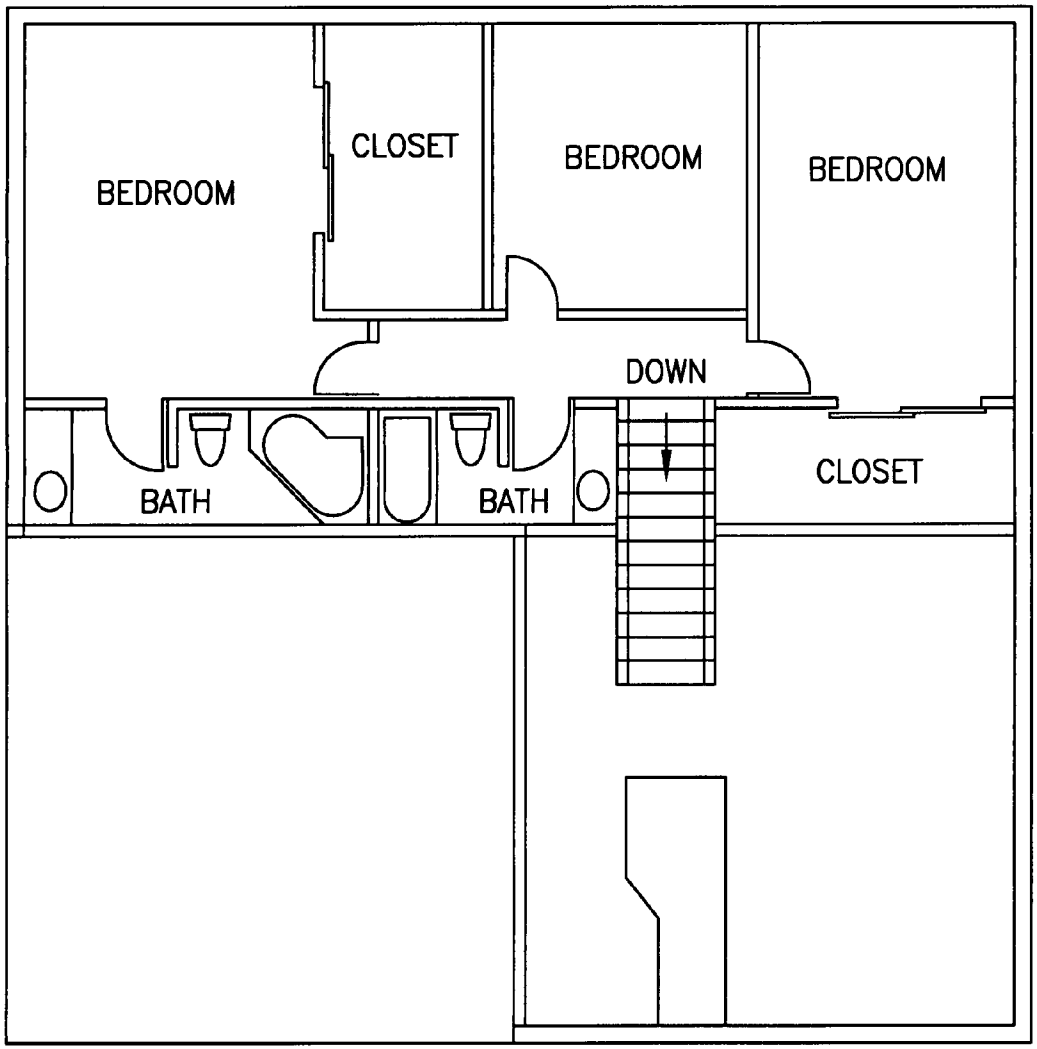
FIG. 9 is a plan view of yet another alternate second floor of an exemplary residential unit according to the present invention.
Figure 10:
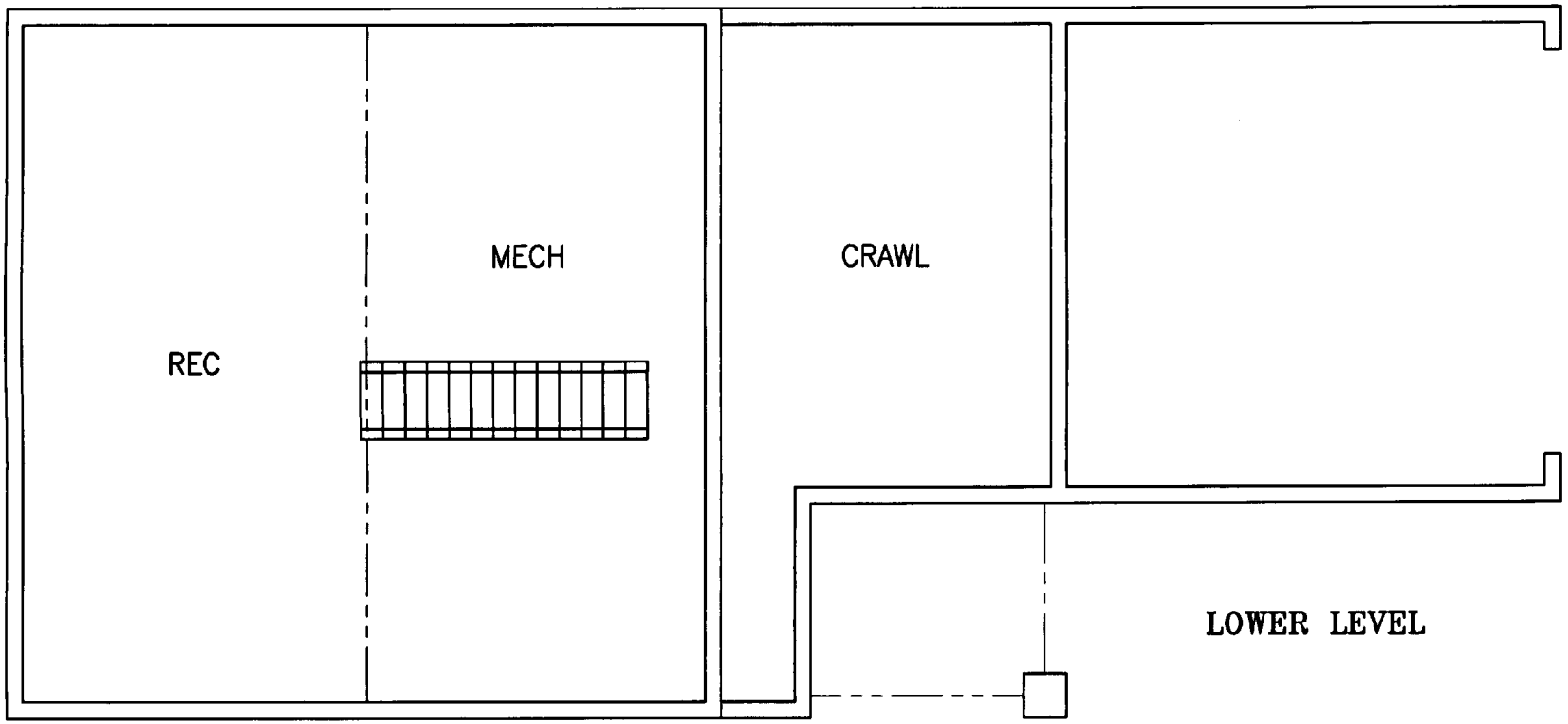
FIG. 10 is a plan view of the lower level of another exemplary residential unit according to the present invention.
Figure 11:
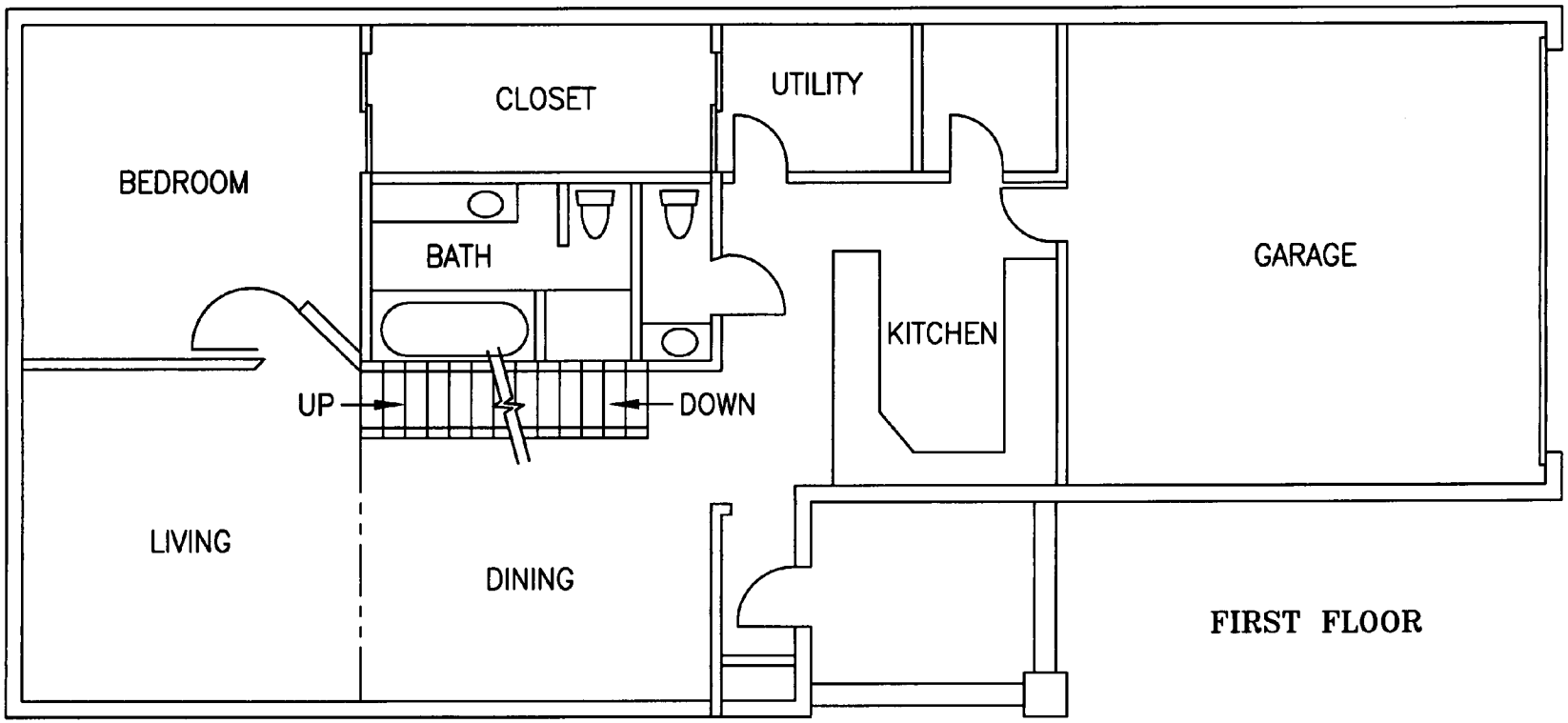
FIG. 11 is a plan view of the first floor of another exemplary residential unit according to the present invention.
Figure 12:
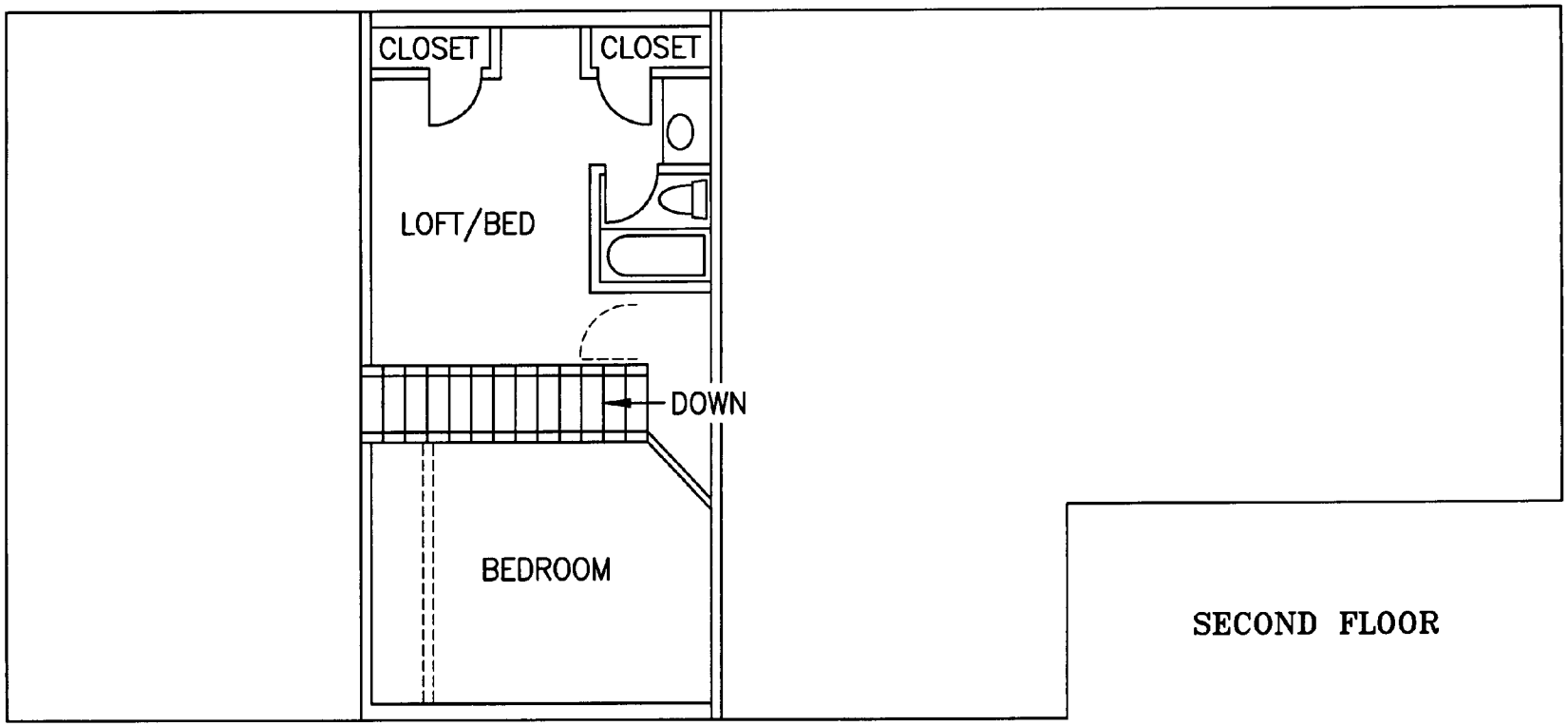
FIG. 12 is a plan view of the second floor of another exemplary residential unit according to the present invention.
Figure 13:
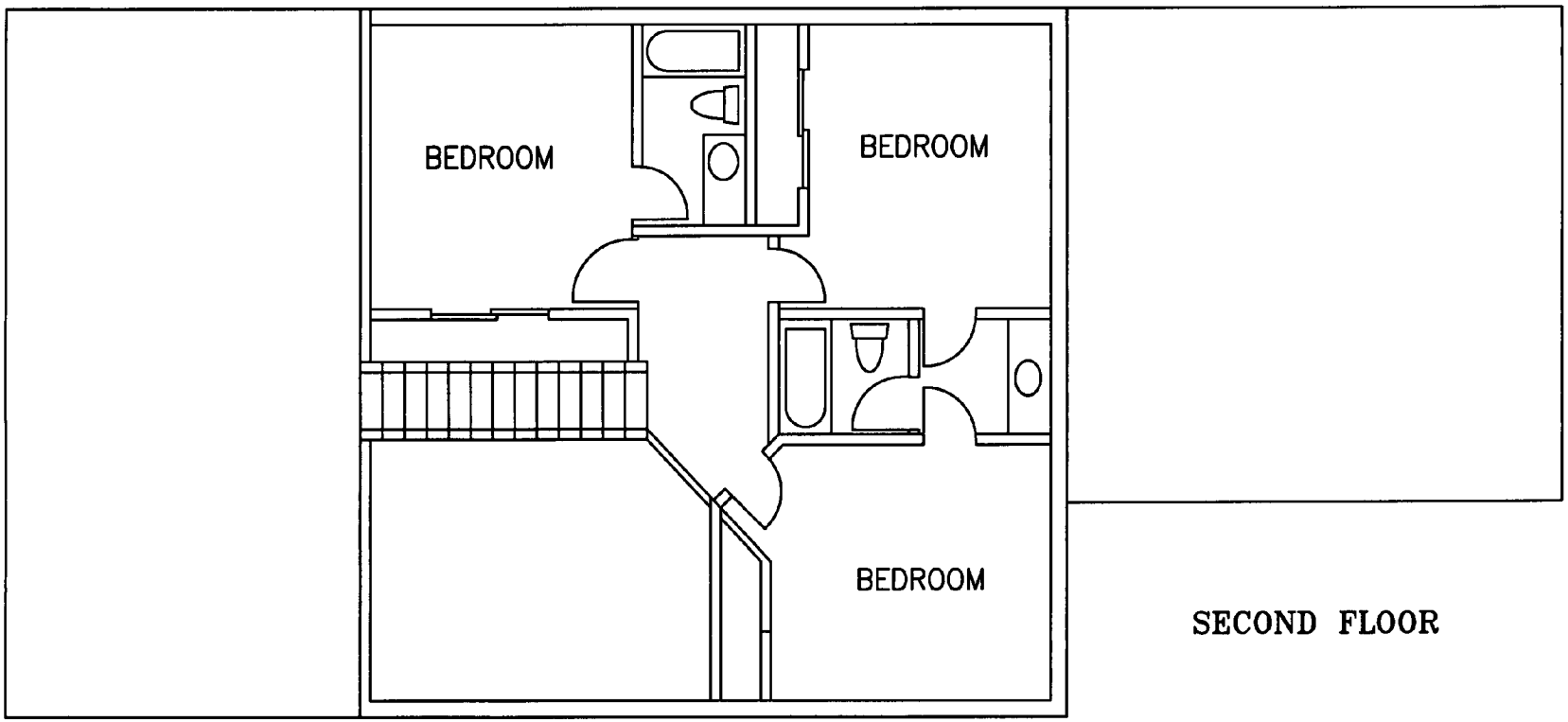
FIG. 13 is an alternate plan view of the second floor of another exemplary residential unit according to the present invention.
Figure 14:
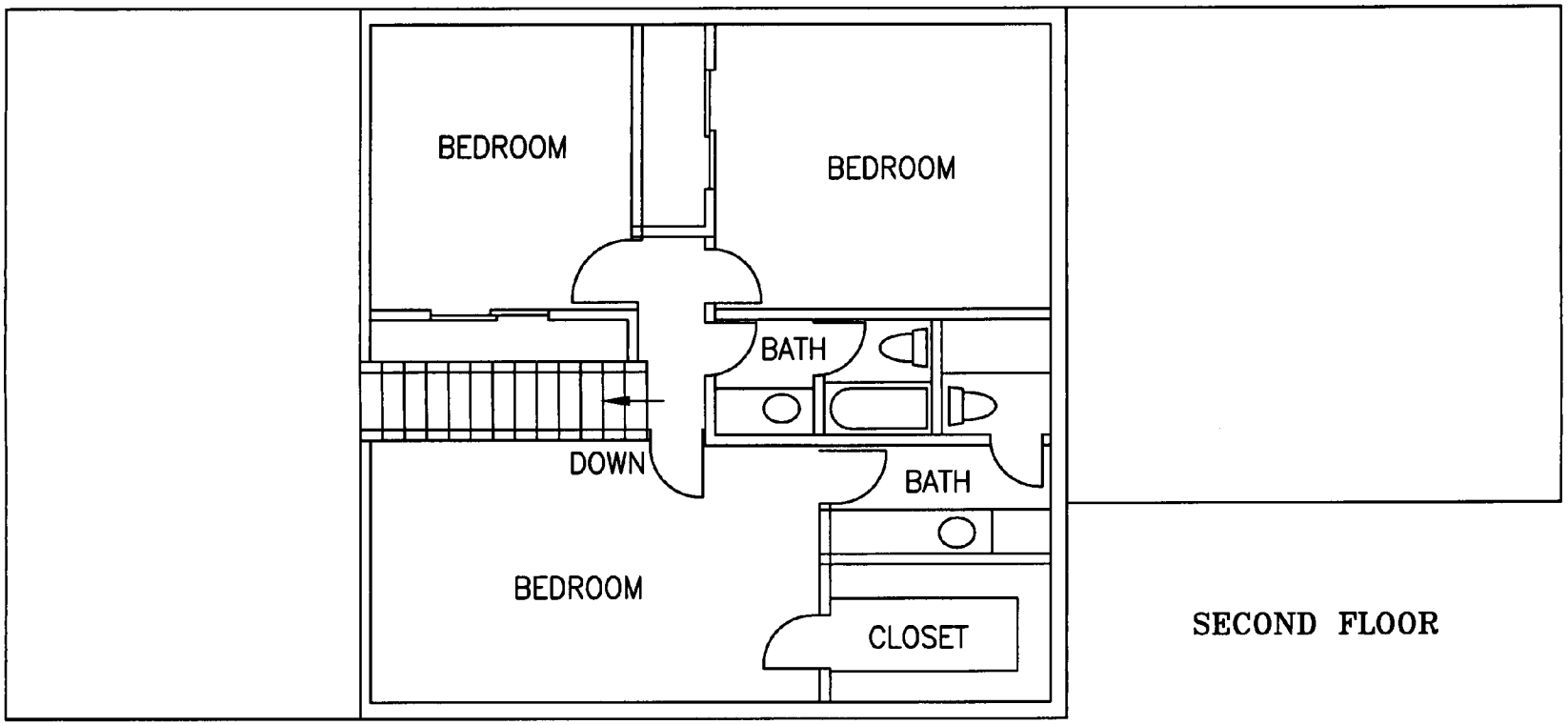
FIG. 14 is a second alternate plan view of the second floor of another exemplary residential unit according to the present invention.

Another exemplary site plan is shown in FIG. 4B. It shows a site plan with traditional streets (versus the more modern cul-de-sac type of subdivisions) that may have alleys in the back of the independent living units. The property line 12 is shown as a dotted line and it bisects the common space 13. With this type of site plan it may be desired to have an external exit or exits in the common space room as it may be the exit to the largest amount of green space accessible per lot.

FIGS. 5–9 show plan views of three floors an independent living unit. In this embodiment the square footage may vary, for example, from about 1753 to 2376 depending on the options chosen. The square footage of the living units is not limited to these dimensions but may be any size home allowed by lot restrictions.

FIGS. 10–14 show plan views of three floors of another independent living unit. In this exemplary embodiment the square footage may vary, for example, from about 1693 to 2584 depending on the options chosen.

Figure 15:
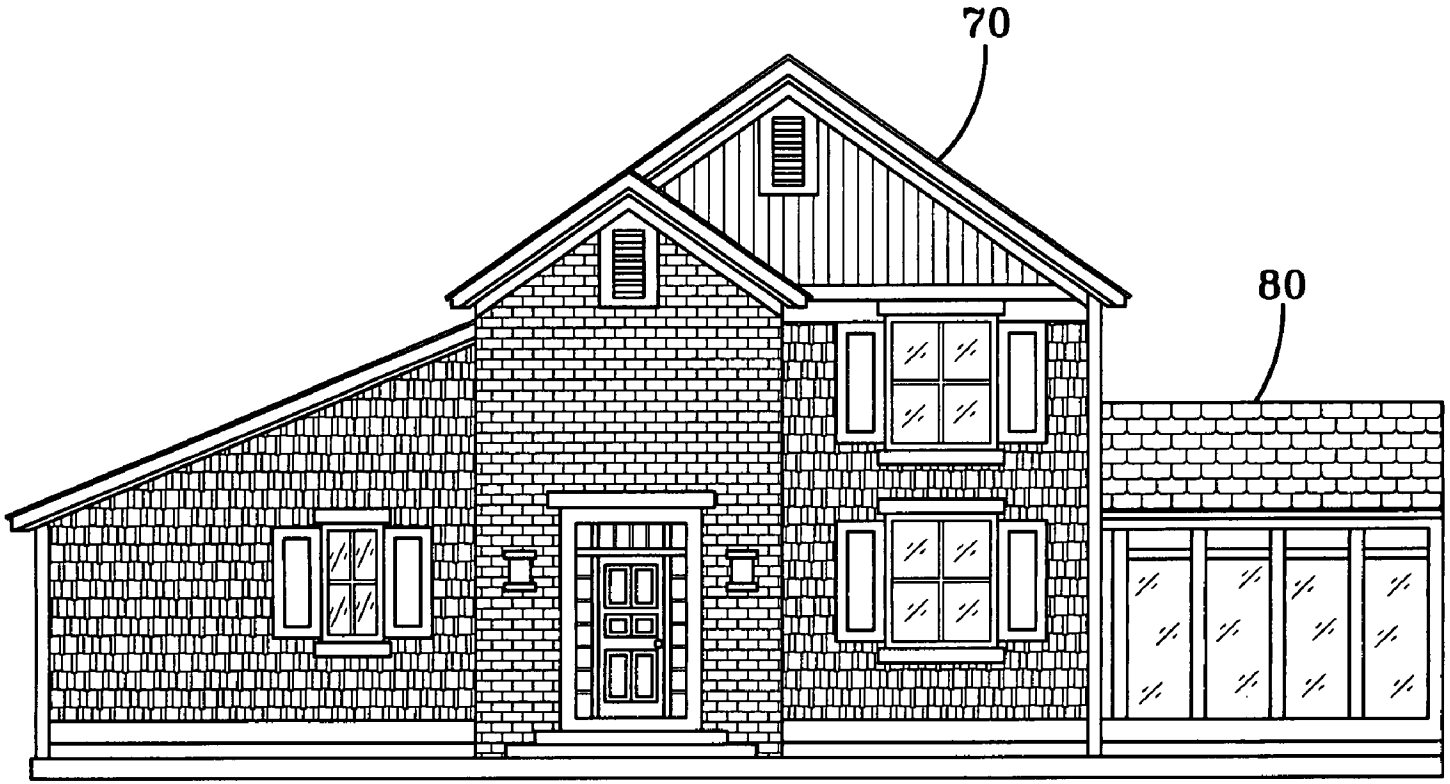
FIG. 15 is a front elevational view of the facade of one exemplary embodiment of a residential unit according to the present invention.

FIG. 15 shows a front elevational view of an exemplary facade of an independent living unit 70 with part of the common space 80 shown. The common space may be connected to another independent living unit (not shown).

Figure 16:
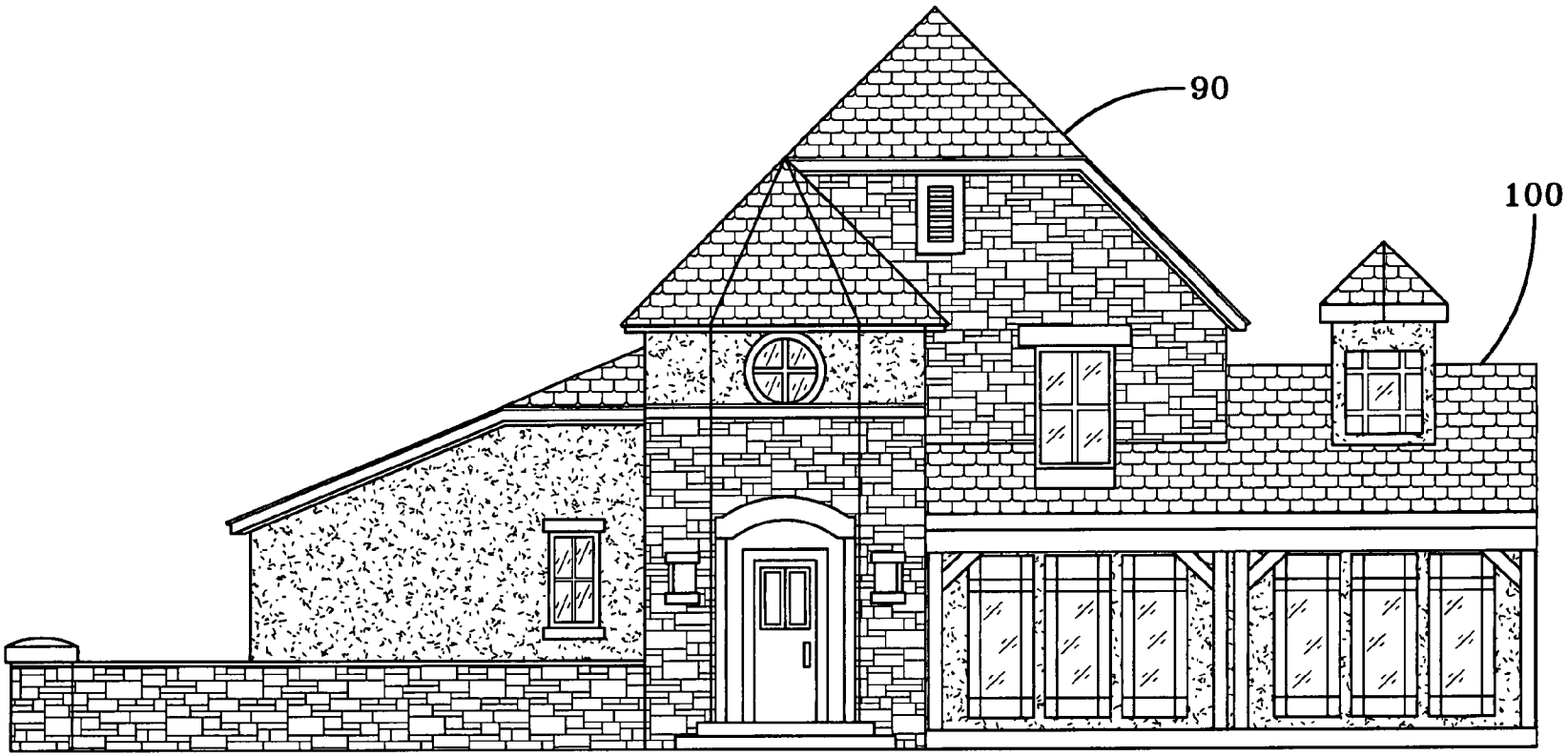
FIG. 16 is a front elevational view of the facade of another exemplary embodiment of a residential unit according to the present invention.

FIG. 16 shows the front elevational view of another exemplary facade of an independent living unit 90 with part of the common space 100 shown.

The following stages are one example of how a typical family may use the residential housing structure of the present invention:

STAGE I—The couple starts life together needing plus or minus 1000 square feet with one bedroom and a loft or small bedroom/office/guest room so they only occupy the smaller structure. This may continue four to five years until they are ready to have children.

STAGE II—As the family needs expand, they move into the adjoining unit. The second unit may be plus or minus 2000 square feet with three bedrooms. At this point the family has choices for the smaller structure, such as: a) rent the small unit, b) provide living space for a parent or other, or c) use the small unit as a home office for example.

STAGE III—The family may then remove any wall dividing the common space and take over both structures. Now they would have, in this example, plus or minus 3000 square feet with two, two-car garages. This may continue several years or until the children are through school and the family's need for space has diminished.

STAGE IV—The family may now reduce their living space in the same place that they expanded. The parents and any remaining children may move back into the larger unit. This provides adequate space and bedrooms. Again at this point, there are similar options for the smaller unit: a) provide living space for a parent or other, b) use the unit as a home office, or c) sell the unit to one of the children, another family member, or an unrelated person. The selling option provides income in retirement and allows the start of a new cycle. In this exemplary transaction, the original owner carries the mortgage in Stage IV, since the overall structure may then be mortgage free. It acts like an annuity except the balance of the mortgage passes on to the estate.

STAGE V—Finally, in the final years of life the couple may move back into the smaller structure and sell or lease the larger structure.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A residential housing arrangement, comprising:

a first and a second property lot, said property lots sharing a common property line; and a first and a second independent living unit, the first and second independent living units positioned on the respective first and second property lots, wherein a commonly shared room, through which the common property line passes, structurally attaches the first and second independent living units.

2. The residential housing arrangement of claim 1, wherein the first and second independent living units are of different sizes.

3. The residential housing arrangement of claim 1, wherein the commonly shared room is divided by a center wall.

4. The residential housing arrangement of claim 1, wherein the commonly shared room is a Florida room with screens or windows.

5. The residential housing arrangement of claim 1, wherein each independent living unit has an attached garage.

6. The residential housing arrangement of claim 1, wherein each independent living unit has an outside entry.

7. The residential housing arrangement of claim 6, wherein the respective outside entries face in the same direction.

8. The residential housing arrangement of claim 1, wherein the commonly shared room is a hallway.

9. The residential housing arrangement of claim 1, wherein the commonly shared room is a breezeway.

10. The residential housing arrangement of claim 1, wherein the commonly shared room is an activity room.

11. The residential housing arrangement of claim 1, wherein the commonly shared room is a laundry room.

12. The residential housing arrangement of claim 1, wherein the commonly shared room is a dining room.

13. The residential housing arrangement of claim 1, wherein the commonly shared room is an exercise room.

* * * * *